United States Patent [19]

Heinzelmann

[11] 4,415,272

[45] Nov. 15, 1983

[54] ELECTRICAL TIMEPIECE WITH HOUR-HAND ADJUSTMENT

[75] Inventor: Hans Heinzelmann, Schramberg, Fed. Rep. of Germany

[73] Assignee: Kieninger & Obergfell Fabrik Für Technische Laufwerke und Apparate, St. Georgen/ Black Forest, Fed. Rep. of Germany

[21] Appl. No.: 316,738

[22] Filed: Oct. 30, 1981

[30] Foreign Application Priority Data

Oct. 30, 1980 [DE] Fed. Rep. of Germany ..... 3041040

[51] Int. Cl.[3] ..... G04C 17/00; G04B 17/12

[52] U.S. Cl. ..... 368/69; 368/185

[58] Field of Search ..... 368/69, 70, 76, 80, 368/185, 190, 220

[56] References Cited

U.S. PATENT DOCUMENTS

| | | | |
|---|---|---|---|
| 3,358,437 | 12/1967 | Burg | 368/190 |
| 3,587,224 | 6/1971 | Ganter | 368/185 |
| 3,766,730 | 10/1973 | Kishida et al. | 368/185 |
| 4,259,735 | 3/1981 | Vuille | 368/185 |

*Primary Examiner*—Vit W. Miska

*Attorney, Agent, or Firm*—Karl F. Ross

[57] ABSTRACT

A battery-operated watch or clock has a knob which is axially shiftable between a first terminal position recessed in a rear housing wall and a second terminal position projecting therefrom. In the recessed position, in which the knob is manually rotatable upon removal of a battery cover surrounding same, its rotation resets both the minute and hour hands of the timepiece to enable its adjustment, especially upon a replacement of a spent battery. In the projecting position, such rotation only displaces the hour hand to facilitate a changeover between standard and daylight-saving time or an adjustment to a different time zone.

12 Claims, 5 Drawing Figures

ELECTRICAL TIMEPIECE WITH HOUR-HAND ADJUSTMENT

FIELD OF THE INVENTION

The present invention relates to an electrical timepiece with a battery-operated clockwork.

BACKGROUND OF THE INVENTION

Watches and clocks driven by a stepping motor in response to signals from a frequency-stabilized oscillator, especially one of the crystal-controlled type, tend to keep time with great precision over a period of many months. There is, generally, no need for resetting the hands of the timepiece except when it becomes necessary to replace a spent battery. It is therefore not unusual, especially with traveling clocks, to make a resetting knob of a high-precision timepiece accessible only upon removal of a lid overlying a battery compartment, thereby preventing any undesired change in the position of the clock hands.

Still, a changeover from standard to daylight-saving time or vice versa may call for an out-of-turn readjustment by one full hour; such adjustment, by one or more hours, may also be required when the user travels from one time zone to another.

The readjustment of a timepiece by a given number of hours is, of course, possible through manipulation of the resetting knob referred to. This operation, however, is not only inconvenient but liable to impair the accuracy of the current time indication by accidentally modifying the position of the minute hand. It has, therefore, already been proposed to provide a clockwork with two separate setting members engaging respective gears which are coupled to each other by a friction clutch, rotation of one of these members resetting both the minute and hour hands while rotation of the other member resets only the hour hand; see German laid-open application No. 2,828,996 published Apr. 17, 1980. The clutch disclosed in that German publication also provides 12 distinct relative angular positions between a minute shaft and an hour shaft in which they are yieldably indexed.

OBJECTS OF THE INVENTION

An object of my present invention is to provide a simplified mechanism for the selective adjustment of both hands or only the hour hand of a timepiece.

Another object is to provide means in such a timepiece for enabling an adjustment of the hour hand by a setting knob not normally accessible for a change in the position of the minute hand.

SUMMARY OF THE INVENTION

A timepiece according to my invention has a clockwork whose minute shaft is rotated by battery-operated drive means and communicates its rotation to a tubular hour shaft with a 1:12 step-down ratio via transmission means including a first gear positively coupled with the minute shaft, a second gear positively coupled with the hour shaft, and yieldable detent means interconnecting the two gears for joint rotation in any of a plurality of relative angular positions whose peripheral spacing corresponds to a 30° travel of the hour hand with a given setting of the minute hand. A manually rotatable setting member is mounted in the housing of the timepiece for displacement in an axial direction, parallel to the two shafts, between a first and a second terminal position; this member carries pinion means meshing with the first gear in the first terminal position and with the second gear in the second terminal position for enabling adjustment of the minute and hour hands in the former position and of the hour hand alone in the latter position. Such selective adjustment of only the hour hand is possible by making the detent means effective in the first terminal position to entrain the hour shaft but ineffective to transmit manual rotation of the second gear in the second terminal position to the first gear—and thus to the minute shaft—against the resistance of the associated drive means.

The setting member advantageously has indexing means coacting with parts of the housing in order to be yieldably retained in either one of its terminal postions. The indexing means may be formed by a bifurcate extension of a stem of that member whose resilient prongs have projections coacting with a supporting plate inside the housing to establish these terminal positions.

In accordance with a more particular feature of my invention, the stem of the setting member carries a knob which is recessed into the rear housing wall in its first terminal position but projects from the wall in its second terminal position in which it is therefore readily manipulable. In its recessed position, in which manual rotation of the knob is relatively difficult, a depression in the rear wall gives enough access to the knob to enable its extraction in order to place the setting member in its second terminal position, e.g. for the purpose of changing from standard to daylight-saving time. If, however, the minute hand of the clockwork must also be readjusted, manual rotation in the recessed position is facilitated by the removal of a lid which is seated in the rear wall and is formed with the aforementioned depression. Since such readjustment in a timepiece of this type usually coicides with the replacement of a spent battery, the lid may overlie a compartment accommodating such a battery.

Pursuant to another more particular feature of my invention, the pinion means carried by the setting member are a first and a second pinion mounted on its stem to mesh with the first and the second gear of the transmission means in the first and the second terminal position, respectively, of that member. The two gears preferably have identical diameters and numbers of teeth which are aligned in any of their relative angular positions established by the detent means. The two pinions, which of course will then also have to be of like diameter and identical number of teeth, advantageously have confronting faces separated by an axial distance which is less than the axial distance separating remote faces of the associated gears from each other whereby both pinions mesh with respective gears in an intermediate position of the setting member. The latter, therefore, is never fully disengaged from the clockwork and can be readily shifted from one terminal position into the other.

In conformity with still another advantageous feature of my invention, the detent means coupling the two gears to each other comprises a resilient arm which is integral with the second gear and has a beveled tip receivable in any of m notches that are peripherally equispaced on the first gear, m being an integer different from 1 divisible into 12. The coupling between the second gear and the hour shaft then includes a gear train which forms part of the aforementioned transmission means and has a step-down ratio of 1:n, with $m=12/n$. The two integers m and n may be 3 and 4, for example.

BRIEF DESCRIPTION OF THE DRAWING

The above and other features of my invention will now be described in detail with reference to the accompanying drawing in which.

SPECIFIC DESCRIPTION

Figure 1:
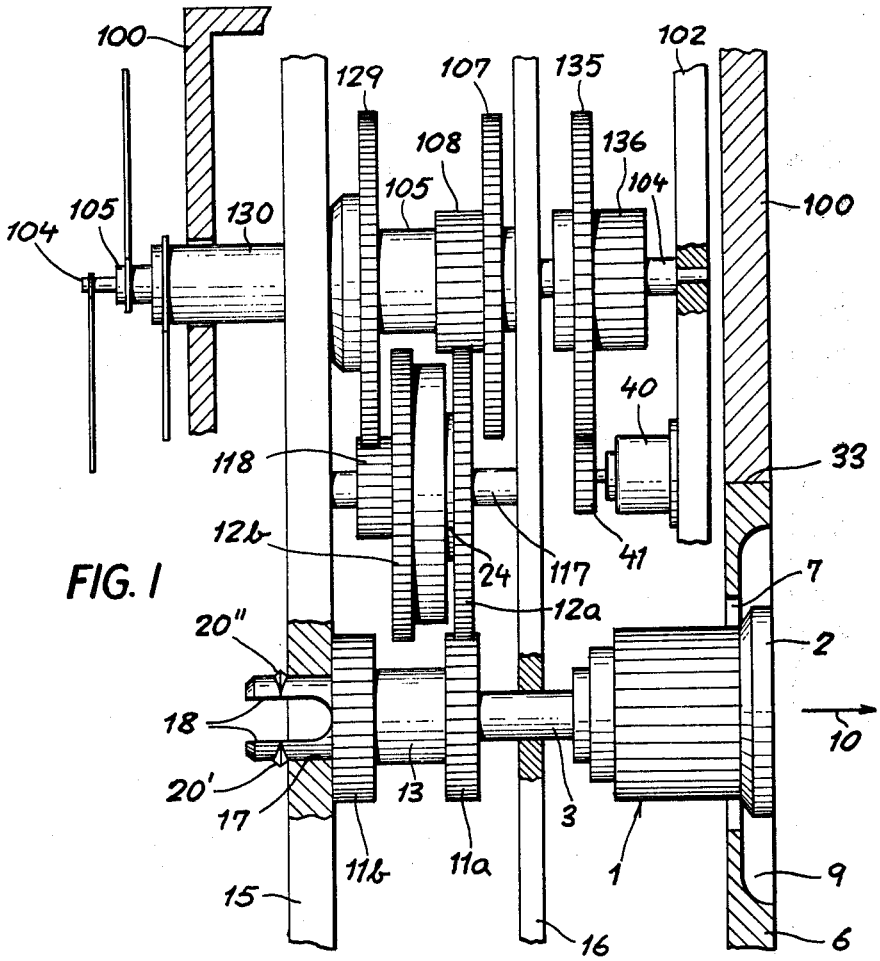
FIG. 1 is a somewhat diagrammatic elevational view of a clockwork in a timepiece embodying my invention, showing a setting member in a first terminal position thereof.
Figure 2:
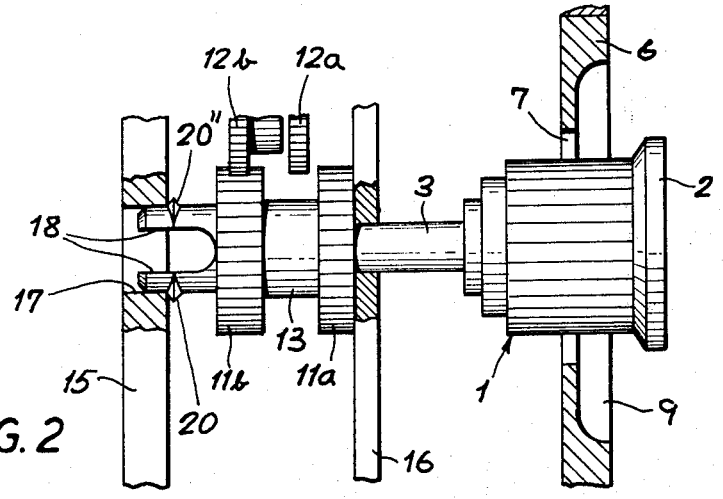
FIG. 2 is a view of description of FIG. 1 showing the setting member in a second terminal position thereof.
Figure 5:
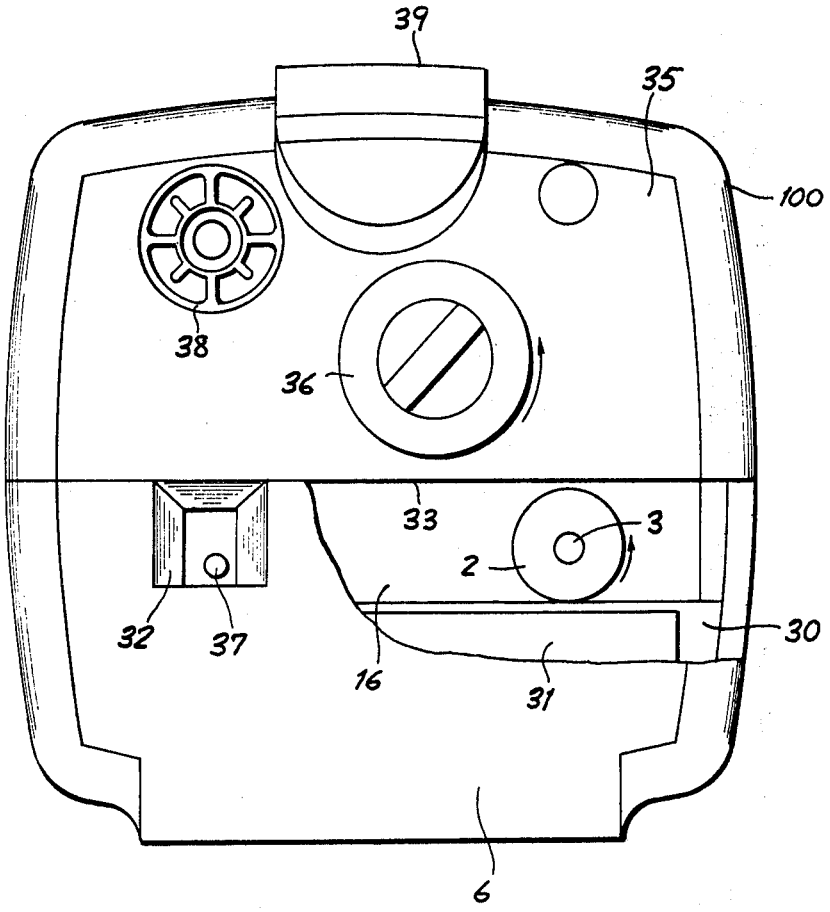
FIG. 5 is a rear view (parts broken away) of the timepiece shown in FIGS. 1 and 2.

FIGS. 1 and 2 show the interior of a housing 100 of a timepiece (e.g. a traveling clock) embodying my invention whose clockwork is driven by a stepping motor 40 via nonillustrated conventional electronic circuitry, the motor being powered by a battery 31 seen partly in FIG. 5. A pinion 41 of motor 40 meshes with a gear 135 on a seconds shaft 104 whose rear end is journaled in a mounting plate 102 and whose opposite end traverses a tubular minute shaft 105 which in turn passes through a tubular hour shaft 130. The three coaxially nested shafts 104, 105 and 130 have staggered extremities which project from a front wall of housing 100 and respectively carry a seconds hand 4, a minute hand 5 and an hour hand 30.

Gear 135 is integral with a pinion 136 which, through a conventional step-down transmission not shown, drives a gear 107 at one-sixtieth its own rate of rotation. Gear 107, which is keyed to minute shaft 105, is rigid with a pinion 108 driving a gear 129—keyed to hour shaft 130—via a similar transmission of step-down ratio 1:12. The latter transmission comprises two gears **12*a*, 12*b* on an ancillary shaft 117 parallel to the three nested shafts referred to, shaft 117 being journaled in a front mounting plate 15 and in an intermediate mounting plate 16 also supporting the hour shaft 130 and the minute shaft 105, respectively. Gears 12*a* and 12*b* are of identical diameter and pitch, as are two pinions 11*a* and 11*b* on a stem 3 of an axially shiftable setting member 1. Gears 12*a* and 12*b* are coupled for joint rotation via detent means in the form of a yieldable jaw clutch which is formed in part by a boss 24 of gear 12*a* and will be more fully described hereinafter with reference to FIGS. 3 and 4. Stem 3, which is parallel to shaft 117, is slidably and rotatably mounted in plates 15 and 16 between which its two pinions 11*a* and 11*b* can be shifted between two terminal positions respectively illustrated in FIGS. 1 and 2. These pinions have a common hub 13, rigid with stem 5, whose axial length is somewhat less than the axial distance of the mutually averted faces of gears 12*a* and 12*b* whereby at least one pinion is always in mesh with its associated gear in any axial position of setting member 1. Stem terminates at its front end in a bifurcation 18 whose resilient prongs carry projections 20' and 20''; the latter coact with opposite surfaces of mounting plate 15 to hold the member 1 in either of the two terminal positions shown in FIGS. 1 and 2**.

The opposite end of stem 3 is rigid with a knob 2 which has a milled peripheral surface and passes through an aperture 7 in a lid 6 which forms a removable part of a rear housing wall. 6 has a depression 9 which surrounds an enlarged flange of head 2 and allows it to be gripped with the fingers for displacement, as indicated by an arrow 10, from the first terminal position of FIG. 1 to the second terminal position of FIG. 2. In the first position, in which pinion **11*a* meshes with gear 12*a* while pinion 11*b* abuts the plate 15, manual rotation of knob 2 is difficult if not impossible unless the lid 6 is first removed; in the second position, in which the knob 2 projects rearwardly from lid 6 while pinion 11*a* abuts the plate 16 and pinion 11*b* meshes with gear 12*b***, such rotation is readily possible thanks to the milled peripheral surface now accessible.

Figure 4:
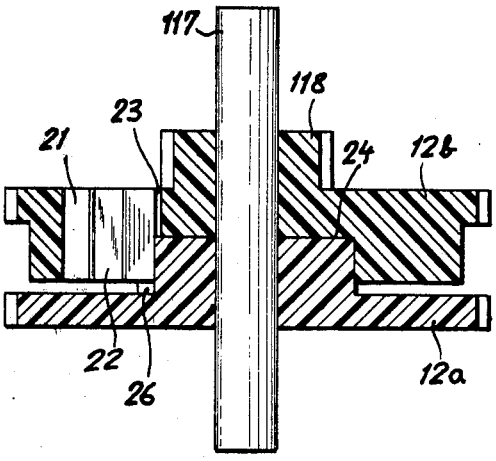
FIG. 4 is a cross-sectional view taken on the line IV—IV of FIG. 3.
Figure 3:
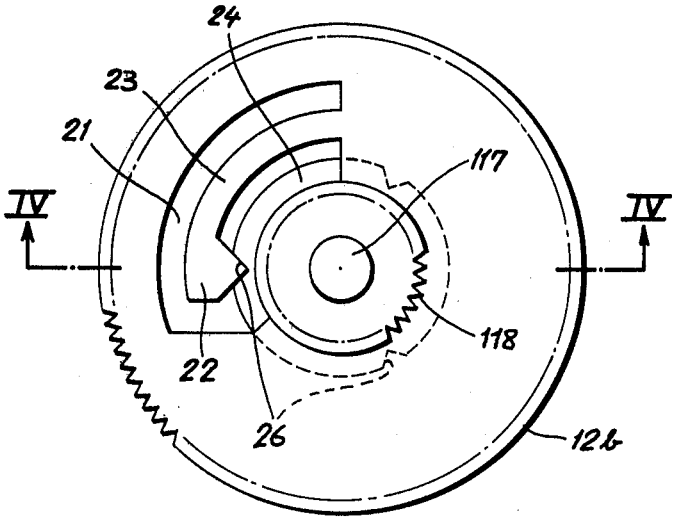
FIG. 3 is a face view, drawn to a larger scale, of a transmission with yieldable detent means forming part of the clockwork of FIGS. 1 and 2.

Reference will now be made to FIGS. 3 and 4 for a description of the detent means coupling gear **12*a* to gear 12*b*. Both gears are axially fixed on shaft 117 though not more than one of them may be keyed to that shaft for rotation therewith. The body of gear 12*b* is recessed to accommodate the boss 24 of gear 12*a* and is further provided with a sectoral groove 21 in which an arm 23 integral with that body is limitedly swingable in a radial direction. A beveled tip 22 of arm 23 normally engages in one of three peripheral notches 26 of boss 24 whereby gear 12*b* is entrained by the intermittently rotating gear 12*a*; this entrainment takes place against a negligible resistance of step-down transmission 118, 129 and hour shaft 130. When the user removes the lid 6 and turns the knob 2 in the position of FIG. 1, he will be able to rotate both the minute shaft 105 and the hour shaft 130 upon overcoming the drag of a conventional friction coupling in the nonillustrated transmission linking gears 107 and 135 with each other. If, however, the user wishes to reset only the hour shaft, he pulls the knob 2 into the position of FIG. 2 without necessarily removing the lid 6; a turning of knob 2 will then rotate the hour shaft 130 through the intermediary of gears 11*b*, 12*b*, 118 and 129 but will not affect the position of gears 12*a*, 108 and minute shaft 105 inasmuch as the tip 22 of arm 23 will be cammed out of the engaged notch 26 in view of the aforementioned drag resisting any entrainment of gear 12*a* by gear 12*b*. Arm 23 may be molded integral with the body of gear 12*b*** from plastic material.

Because of a step-down ratio of 1:4 in the gearing 118, 129, hour shaft 130 will turn 30° with any 120° rotation of gear **12*b*. The user, therefore, may let the tip 22 drop into the next notch 26 for an advance of a retreat by one hour. A resetting by several hours, e.g. upon a transcontinental or transatlantic flight, will require the passing of one or more notches. Arm 23** must, of course, have a certain elasticity.

As long as the knob 2 is in its recessed position of FIG. 1, it is virtually protected against any accidental change in the setting of the clock hands. Even if the user should forget to restore the knob after pulling it into the position of FIG. 2, any undesired rotation of that knob would change only the setting of the hour hand 30 which could be easily rectified without requiring any repositioning ot the precision-stepped minute hand 5.

As seen in FIG. 5, the rear wall of clock housing 100 has a fixed portion 35 adjoining the removable lid 6 along a line 33. Battery 31 is lodged in a compartment 30 overlain by the lid 6 and can thus be replaced when the lid is lifted off. The lid also has an aperture 32 giving access to a start/stop button 37 by which the battery may be disconnected from the oscillator circuit associated with stepping motor 40 when the clock is not in use. Another rotable knob 36 serves for the adjustment of a nonillustrated alarm hand; an aperture 38 in wall portion 35 gives passage to the sound waves of an alarm-signal generator which can be turned off by a sliding switch 39.

I claim:

1. A timepiece comprising:

a housing having a front wall and a rear wall;

a clockwork in said housing including a tubular hour shaft and a minute shaft coaxially projecting from said front wall;

a minute hand and an hour hand respectively carried on projecting extremities of said minute and hour shafts;

battery-operated drive means coupled with said clockwork for rotating said minute shaft, said clockwork including transmission means communicating the rotation of said minute shaft with a 1:12 step-down ratio to said hour shaft, said transmission means comprising a first gear positively coupled with said minute shaft, a second gear positively coupled with said hour shaft and yieldable detent means interconnecting said gears for joint rotation in any of a plurality of relative angular positions whose peripheral spacing corresponds to a 30° travel of said hour hand with a given setting of said minute hand;

a manually rotatable setting member mounted in said housing for displacement in an axial direction parallel to said shafts between a first and a second terminal position; and pinion means on said setting member meshing with said first gear in said first terminal position and with said second gear in said second terminal position for enabling adjustment of both said hands in said first terminal position and of said hour hand alone in said second terminal position, said detent means being effective in said first terminal position to entrain said hour shaft but being ineffective to transmit manual rotation of said second gear in said second terminal position to said first gear against the resistance of said drive means.

2. A timepiece as defined in claim 1, further comprising indexing means on said setting member coacting with parts of said housing for yieldably retaining said setting member in either of said terminal positions.

3. A timepiece as defined in claim 2 wherein said indexing means comprises a bifurcate extension of said setting member with resilient prongs traversing an aperture in a plate rigid with said housing, said prongs carrying projections engaging opposite surfaces of said plate in respective terminal positions.

4. A timepiece as defined in claim 1, 2 or 3 wherein said setting member comprises a stem traversing said rear wall and carrying a knob recessed into said rear wall in said first terminal position and projecting from said rear wall in said second terminal position, said rear wall having a depression giving access to the recessed knob in said first terminal position for enabling its extraction to place said setting member in said second terminal position.

5. A timepiece as defined in claim 4 wherein said rear wall is provided with a removable lid formed with said depression, removal of said lid exposing a peripheral surface of said knob facilitating manual rotation thereof in said first terminal position.

6. A timepiece as defined in claim 5 wherein said housing is provided with a battery compartment overlaid by said lid.

7. A timepiece as defined in claim 5 wherein said peripheral surface is milled for easier gripping.

8. A timepiece as defined in claim 4 wherein said pinion means comprises a first and a second pinion on said stem, said first pinion meshing with said first gear in said first terminal position, said second pinion meshing with said second gear in said second terminal position.

9. A timepiece as defined in claim 8 wherein said first and second gears have identical diameters and numbers of teeth and are mounted together with said detent means on an ancillary shaft parallel to said stem, the teeth of said gears being aligned in any relative angular position in which said gears are arrestable by said detent means, said first and second pinions having identical diameters and numbers of teeth and having confronting faces separated by an axial distance less than the axial distance separating remote faces of said gears from each other whereby both pinions mesh with the respective gears in an intermediate axial position of said setting member.

10. A timepiece as defined in claim 9 wherein said detent means comprises a resilient arm integral with said second gear having a beveled tip receivable in any of a plurality of peripherally equispaced notches on said first gear, said notches establishing said relative angular positions.

11. A timepiece as defined in claim 10 wherein said second gear is coupled with said hour shaft through a gear train which forms part of said transmission means and has a step-down ratio of 1:n and the number of said notches is $m=12/n$, m and n being integers different from 1.

12. A timepiece as defined in claim 1, 2 or 3 wherein said housing forms abutments respectively engageable by said pinion means in said first and second terminal positions for limiting the axial displacement of said setting member.

* * * * *